United States Patent [19]

Merrick et al.

[11] 4,358,318

[45] Nov. 9, 1982

[54] NICKEL-BASED ALLOY

[75] Inventors: Howard F. Merrick, Suffern; LeRoy R. Curwick, Warwick; Raymond C. Benn, Suffern, all of N.Y.

[73] Assignee: The International Nickel Company, Inc., New York, N.Y.

[21] Appl. No.: 149,316

[22] Filed: May 13, 1980

[51] Int. Cl.[3] ..... C22C 19/05

[52] U.S. Cl. ..... 420/449; 148/162; 148/428

[58] Field of Search ..... 75/171, 170; 148/32, 148/32.5, 162

[56] References Cited

U.S. PATENT DOCUMENTS 4,127,410 11/1978 Merrick et al. ..... 75/171

*Primary Examiner*—R. Dean

*Attorney, Agent, or Firm*—Francis J. Mulligan, Jr.; Raymond J. Kenny

[57] ABSTRACT

Nickel-base alloy containing chromium, aluminum, titanium, molybdenum, cobalt and tungsten has combination of strength and ductility at elevated temperatures, particularly including stress-rupture strength at 980° C. and ductility at 760° C., along with resistance against oxidation and to hot corrosion by combustion products from jet engine fuels. The alloy is especially useful in production of gas turbine rotor blade castings.

11 Claims, No Drawings

NICKEL-BASED ALLOY

BACKGROUND OF THE ART AND PROBLEM

The present invention relates to nickel-base alloys and more particularly to nickel-base alloys having heat and corrosion resistant characteristics desired for gas turbine components, for instance, turbine rotor blades.

Gas turbine engines and utility thereof for powering aircraft and other vehicles or stationary machines are, in general, well known, as also are many needs for materials that will provide strength and corrosion resistance during exposure to heat and corrosive attack from turbine fuel combustion. Some of the more important characteristics needed for gas turbine components such as turbine rotor blades include strength and ductility at elevated temperatures, particularly stress-rupture strength at high elevated temperatures such as 980° C. and elongation at intermediate temperatures of around 760° C., where relatively low ductility is sometimes a detriment, along with resistance to corrosion in kerosene fuel (JP) combustion atmospheres containing sulfur and chlorides. Oxidation resistance especially at very high temperatures of about 1090° C., is also needed. Furthermore, desired characteristics include metallurgical stability and the ductility characteristic of reduction-in-area at shorttime tensile test fracture at intermediate temperatures, which is considered an indicator of resistance of the alloy to thermal fatigue.

DISCOVERY AND OBJECTS

An alloy has now been discovered which provides an especially good combination of the required metallurgical stability, ductility, strength and corrosion and oxidation-resistance at elevated temperatures.

An object of the invention is to provide metal articles having strength, ductility and corrosion resistance in fossil fuel combustion atmospheres.

GENERAL DESCRIPTION

The present invention contemplates an alloy containing, in weight percent, about 0.02% to about 0.2% carbon, about 11.5% to about 12.2% chromium, about 4% to about 8% cobalt, about 4.5% to about 5.2% molybdenum plus tungsten with the ratio of molybdenum to tungsten being about 1.5, about 8.8% to about 9.7% aluminum plus titanium with the ratio of aluminum to titanium being about 0.95, up to about 0.4% boron, about 0.02% to about 0.1% zirconium with the balance being essentially nickel. Presence of about 0.02% or more carbon, advantageously 0.08% to about 0.2% carbon, together with about 0.01% to about 0.03% boron and 0.02% to 0.1% zirconium, advantageously 0.02% to about 0.06% zirconium will promote high temperature strength and ductility. Further it is to be understood that higher boron levels, such as 0.15% to 0.3% boron, together with lower carbon levels, eg. 0.02% to 0.05% carbon may be beneficial in promoting further improvements in high temperature ductility and also in castability. Preferably the alloy contains about 0.15% carbon, about 12.0% chromium, about 6.0% cobalt, about 3.0% molybdenum, about 2.0% tungsten, about 4.5% aluminum, about 4.7% titanium, about 0.02% boron and about 0.03% zirconium. The nickel-base alloys of the present invention are particularly advantageous when vacuum melted and vacuum cast into the form of gas turbine engine hardware, for example, integral turbine wheels and blades.

Molybdenum and tungsten are not substitutional equivalents for each other in the alloy of the invention and these elements should be controlled according to the ranges and proportions specified herein. Sulfur, phosphorus, oxygen, nitrogen and other elements known to be detrimental to nickel-base heat resistant alloys should be avoided or controlled to lowest practical levels. Incidental elements which can be present in amounts up to about 2% total and individually in amounts up to about 0.5% include iron, manganese, tantalum, niobium, hafnium, rhenium and vanadium.

Castings of the alloy are advantageously prepared by vacuum-induction melting and vacuum casting into ceramic shell molds. Heat treatments of the as-cast alloy comprising treatments of about 1 to 3 hours at about 1150° C. to 1093° C., air cooling, and then for about 20 to 30 hours at about 870° C. to 816° C., e.g., 2 hours at 1121° C. plus 24 hours at 843° C. have been found beneficial to corrosion resistance and mechanical properties and are recommended for providing advantageous embodiments of the invention. The heat treatment provides a duplex, large and small size, gamma-prime structure in a gamma matrix and discrete (globular, nonfilm-like) chrome-carbides of the $CR_{23}C_6$ type at the casting grain boundaries. The heat treatment does not change the grain size of the casting.

SPECIFIC DESCRIPTION OF THE INVENTION

An alloy of the invention was made by melting down under vacuum at about 1480° C. a composition analyzed in cast form to contain 0.19% carbon, 11.1% chromium, 5.6% cobalt, 2.9% molybdenum, 2.0% tungsten, 4.3% aluminum, 5.0% titanium, 0.025% boron, 0.03% zirconium, 0.0064% oxygen, 0.0012% nitrogen balance nickel. The molten alloy was superheated in vacuum and poured at about 1510° C. into remelt stock form. The remelt stock of this alloy was remelted under similar conditions with addition of chromium and cast into a preheated shell mold of cast-to-size test bars. The final alloy composition (hereinafter designated as Alloy 1) was 0.16% carbon, 11.5% chromium, 5.9% cobalt, 2.7% molybdenum, 1.9% tungsten, 4.3% aluminum, 5.0% titanium, 0.023% boron, 0.03% zirconium, 0.0038% oxygen, 0.0012% nitrogen balance essentially nickel.

In a similar manner cast-to-size test bars were made from an alloy (hereinafter designated as Alloy 2) analyzed to contain 0.15% carbon, 12.0% chromium, 5.8% cobalt, 2.7% molybdenum, 1.9% tungsten, 4.4% aluminum, 4.5% titanium, 0.023% boron, 0.03% zirconium, 0.0035% oxygen, 0.0016% nitrogen, balance essentially nickel.

Cast-to-size tensile test bars of Alloys 1 and 2 were machined within the gage length to a diameter of about 6.4 mm and the heat treated in argon for 2 hours at about 1120° C. and for 24 hours at about 840° C. Stress-rupture results obtained with these alloys as heat treated are set forth in Table I.

TABLE I

| Alloy No. | Temp. (¼C.) | Stress (MPa) | Life (hrs) | El (%) | RA (%) |
|---|---|---|---|---|---|
| 1 | 870 | 207 | 455.9* | — | — |
| 1 | 815 | 276 | 1127.8* | — | — |
| 1 | 980 | 200 | 29.9 | 3.2 | 3.0 |
| 1 | 760 | 648 | 89.7 | 4.0 | 10.3 |
| 2 | 870 | 207 | 456.3* | — | — |

TABLE I-continued

| Alloy No. | Temp. (°C.) | Stress (MPa) | Life (hrs) | El (%) | RA (%) |
|---|---|---|---|---|---|
| 2 | 815 | 276 | 1127.9* | — | — |
| 2 | 980 | 200 | 12.3 | 3.2 | 5.4 |
| 2 | 760 | 648 | 97.1 | 4.8 | 5.6 |

*Test stopped, no break

The stability factor (Nv) comprising a measure of the tendency for sigma phase to form in the gamma phase matrix of the alloy, generally calculated on the basis of excluding from the matrix composition that nickel combined as $Ni_3(Al,Ti)$ and as nickel boride and those amounts of chromium, molybdenum and tungsten combined as carbides, allowing for impurities in each non-matrix phase and particularly calculated as described in "Strengthening Mechanisms in Nickel-base Superalloys" by R. F. Decker, International Nickel Co., Inc., presented at Steel Strengthening Mechanisms Symposium, Zurich, Switzerland, May 5 and 6, 1969 was 2.24 for Alloy 1 and 2.25 for Alloy 2. No sigma phase was detected in either Alloy after the stressed exposure at 870° C. and 815° C. as set forth in Table I.

Test bars of Alloys 1 and 2, heat treated as described hereinbefore for other test bars, were machined within the gage length to a diameter of about 6.4 mm after heat treatment. Stress rupture test results of these specimens are set forth in Table II. No sigma phase was detected in either Alloy after stressed exposure at 870° C. as set forth in Table II.

TABLE II

| Alloy No. | Temp. (°C.) | Stress (MPa) | Life (hrs) | El (%) | RA (%) |
|---|---|---|---|---|---|
| 1 | 870 | 207 | 840* | — | — |
| 1 | 760 | 648 | 95.7 | 7.2 | 11.3 |
| 1 | 980 | 200 | 23.6 | 4.0 | 6.0 |
| 1 | 760 | 648 | 77.0 | 5.6 | 11.3 |
| 2 | 870 | 207 | 840* | — | — |
| 2 | 980 | 200 | 16.9 | 2.4 | 1.4 |
| 2 | 980 | 200 | 16.7 | 3.2 | 2.6 |
| 2 | 760 | 648 | 103.3 | 6.4 | 6.1 |

*Test stopped, no break

The data in Tables I and II together demonstrates the utility of the Alloys of the present invention for the purposes intended.

The alloys of the present invention can be prepared in directionally solidified and single crystal form. In such cases, it is expected that it may prove advantageous to decrease the optimum levels of carbon, boron and zirconium.

The present invention is particularly applicable for providing cast articles to be used as rotor blades, stator vanes or other turbine components for fossil-fueled gas turbines, including aircraft, automotive, marine and stationary power plant turbines, and is generally applicable for heat and corrosion resistant structural and/or operational articles, e.g., braces, supports, studs, threaded connectors and grips, and other articles. When desired the alloy can be solidified as multiple grain or single grain castings with random, controlled or unidirectional solidification, and may be slow cooled, air cooled, quenched or chilled. Furthermore, if desired, the alloy may be produced as wrought or powder metallurgical products.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. An alloy metallurgically stable with respect to the formation of sigma phase when placed under stress at temperatures up to about 1100° C. and having resistance to the detrimental effects of oxidation and corrosion at high temperatures consisting essentially, in weight percent, up to about 0.2% carbon, about 11.5% to about 12.2% chromium, about 4% to about 8% cobalt, about 4.5% to about 5.2% molybdenum plus tungsten with the ratio of molybdenum to tungsten being about 1.5, about 8.8% to about 9.7% aluminum plus titanium with the ratio of aluminum to titanium being about 0.95, up to about 0.4% boron, up to about 0.1% zirconium with the balance being essentially nickel, said alloy being characterized by a life-to-rupture at 760° C. under a stress of 648 MPa of about 100 hours and by a life-to-rupture at 980° C. under a stress of 200 MPa of about 25 hours and being characterized by being devoid of sigma phase after exposure to stress at temperatures up to about 1100° C.

2. An alloy as in claim 1 wherein the carbon content is about 0.14% to about 0.18%, the boron content is about 0.01% to about 0.03% and the zirconium content is about 0.02% to about 0.06%.

3. An alloy as in claim 2 wherein the cobalt content is about 6%.

4. An alloy as in claim 1 wherein the carbon content is about 0.02% to about 0.05% and the boron content is about 0.15% to about 0.3%.

5. An alloy as in claim 1 containing about 0.15% carbon, about 12% chromium, about 6% cobalt, about 3% molybdenum, about 2% tungsten, about 4.5% aluminum, about 4.7% titanium, about 0.02% boron and about 0.03% zirconium.

6. An alloy heat treated after casting for about 1 to 3 hours at 1150° C., air cooled, and then for about 20 to 30 hours at 816° C. to 870° C., metallurgically stable with respect to the formation of sigma phase when placed under stress at temperatures up to about 1100° C. and having resistance to the detrimental effects of oxidation and corrosion at high temperatures consisting essentially, in weight percent, about 0.02% to about 0.2% carbon, about 11.5% to about 12.2% chromium, about 4% to about 8% cobalt, about 4.5% to about 5.2% molybdenum plus tungsten with the ratio of molybdenum to tungsten being about 1.5, about 8.8% to about 9.7% aluminum plus titanium with the ratio of aluminum to titanium being about 0.95, up to about 0.4% boron, about 0.02% to about 0.1% zirconium with the balance being essentially nickel, said heat treated alloy being characterized by a life-to-rupture at 760° C. under a stress of 684 MPa of about 100 hours and by a life-to-rupture at 980° C. under a stress of 200 MPa of about 25 hours and being characterized by being devoid of sigma phase after exposure to stress at temperatures up to about 1100° C.

7. A heat treated alloy as in claim 6 wherein the carbon content is about 0.14% to about 0.18%, the boron content is about 0.01% to about 0.03% and the zirconium content is about 0.02% to about 0.06%.

8. A heat treated alloy as in claim 7 wherein the cobalt content is about 6%.

9. A heat treated alloy as in claim 6 wherein the carbon content is about 0.02% to about 0.05% and the boron content is about 0.15% to about 0.3%.

10. A heat treated alloy as in claim 6 containing about 0.15% carbon, about 12% chromium, about 6% cobalt, about 3% molybdenum, about 2% tungsten, about 4.5% aluminum, about 4.7% titanium, about 0.02% boron and about 0.03% zirconium.

11. A gas turbine engine hardware casting made from the heat treated alloy of claim 6.

* * * * *